US007992477B2

(12) United States Patent
Yuyama et al.

(10) Patent No.: US 7,992,477 B2
(45) Date of Patent: Aug. 9, 2011

(54) MEDICINE FEEDING DEVICE

(75) Inventors: Shoji Yuyama, Toyonaka (JP); Hiroshi Hashimoto, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 1274 days.

(21) Appl. No.: 11/178,455

(22) Filed: Jul. 12, 2005

(65) Prior Publication Data

US 2006/0104765 A1 May 18, 2006

(30) Foreign Application Priority Data

Jul. 12, 2004 (JP) ..... 2004-204720

(51) Int. Cl.
*B26D 5/08* (2006.01)

(52) U.S. Cl. ..... 83/385; 83/618

(58) Field of Classification Search ..... 83/102, 83/78, 202, 203, 212.1, 282, 385–387, 613, 83/618; 206/532, 534, 531; 221/30, 31; 414/412, 411

See application file for complete search history.

(56) References Cited

U.S. PATENT DOCUMENTS

| | | | | |
|---|---|---|---|---|
| 4,428,709 | A * | 1/1984 | Peters | 414/412 |
| 4,690,676 | A * | 9/1987 | Moulding et al. | 604/189 |
| 4,909,414 | A * | 3/1990 | Heath | 221/25 |
| 4,975,015 | A * | 12/1990 | Harding | 414/412 |
| 5,325,968 | A * | 7/1994 | Sowden | 206/532 |
| 5,332,096 | A * | 7/1994 | Battaglia | 206/532 |
| 5,348,158 | A * | 9/1994 | Honan et al. | 206/531 |
| 5,356,010 | A * | 10/1994 | Weinstein | 206/532 |
| 5,431,283 | A * | 7/1995 | Weinstein et al. | 206/531 |
| 5,509,773 | A * | 4/1996 | Connor et al. | 414/412 |
| 5,740,717 | A * | 4/1998 | Sowden et al. | 83/879 |
| 5,816,404 | A * | 10/1998 | Seidler | 206/461 |
| 6,443,307 | B1 * | 9/2002 | Burridge | 206/532 |
| 6,557,740 | B1 * | 5/2003 | Dent | 225/104 |
| 6,776,285 | B2 * | 8/2004 | Shibata | 206/469 |
| 7,063,211 | B2 * | 6/2006 | Williams-Hartman | 206/532 |
| 7,175,044 | B2 * | 2/2007 | Benktzon et al. | 221/25 |
| 7,395,928 | B2 * | 7/2008 | Bertsch et al. | 206/531 |
| 7,448,496 | B2 * | 11/2008 | Williams-Hartman | 206/532 |
| 7,536,938 | B2 * | 5/2009 | Kim | 83/74 |
| 7,540,222 | B2 * | 6/2009 | Kim | 83/84 |

(Continued)

FOREIGN PATENT DOCUMENTS

| | | |
|---|---|---|
| JP | 3-688 | 1/1991 |

(Continued)

OTHER PUBLICATIONS

Japanese Office Action (in English language) issued May 18, 2010 in corresponding Japanese Patent Application No. 2005-201555.

*Primary Examiner* — Sean Michalski
(74) *Attorney, Agent, or Firm* — Wenderoth, Lind & Ponack, L.L.P.

(57) ABSTRACT

A medicine feeding device including a support portion (32) for supporting a seal surface side of a press through pack (5), a press section (33) for pressing the housing recess portions (9) from one side other than the seal surface of the press through pack (5), and a cutter (38) for making a cut slit in the sheet (11) at a boundary portion between the housing recess portions (9) and the seal surface (8) at least before the sheet (11) is broken or the medicine (6) is damaged by the pressure exerted by the press section (33).

12 Claims, 14 Drawing Sheets

U.S. PATENT DOCUMENTS

2003/0034271 A1* 2/2003 Burridge ..... 206/532
2005/0023180 A1* 2/2005 Intini ..... 206/532
2005/0210682 A1* 9/2005 Bartholin ..... 30/162
2006/0027480 A1* 2/2006 Buss ..... 206/532
2006/0138017 A1* 6/2006 Gelardi ..... 206/532
2006/0151514 A1* 7/2006 Drought et al. ..... 221/25
2006/0249422 A1* 11/2006 Bates ..... 206/532
2007/0227932 A1* 10/2007 Bobbett et al. ..... 206/532
2008/0308449 A1* 12/2008 Intini ..... 206/532
2009/0057185 A1* 3/2009 Gelardi et al. ..... 206/532
2009/0145800 A1* 6/2009 Bowers et al. ..... 206/532

FOREIGN PATENT DOCUMENTS

JP 2552429 8/1996

* cited by examiner

MEDICINE FEEDING DEVICE

BACKGROUND OF THE INVENTION

1. Technical Field

The present invention relates to a medicine feeding device for taking out medicines (mostly, tablets or pills) that are packaged in a press through pack.

2. Description of the Related Art

Conventionally, there has been proposed a medicine feeding device which is designed so that a housing section of a press through pack is stopped at a press position of a press device based on a detection output of detection means so that medicines can be taken out continuously.

However, with this conventional medicine feeding device, it has been the case that the housing section is forcedly pressed by the press device to break the sheet by the medicine housed therein, thereby allowing the medicine to be taken out. As a result of this, there is a fear that part of the broken sheet may be separated and drop off so as to be mixed into the taken-out medicine. Further, housed medicines may be damaged before breaking the sheet is another fear.

Accordingly, an object of the present invention is to provide a medicine feeding device which allows medicines alone to be taken out of the press through pack smoothly without being damaged.

SUMMARY OF THE INVENTION

The present invention provides, as a means for solving the above-described problems, a medicine feeding device for feeding medicines from a press through pack in which a housing member is formed with a plurality of housing recess portions provided in at least one line on a seal surface side of a plate-shaped member and in which a sheet is stuck to the seal surface of the housing member with medicines housed in the housing recess portions. The device comprises a support portion for supporting the seal surface side of the press through pack; a press section for pressing the housing recess portions from one side other than the seal surface of the press through pack; and a cutter for making a cut slit in the sheet at least before the sheet is broken or the medicine is damaged by the press exerted by the press section.

The cutter may be so shaped that the cutter makes a linear cut slit, or extends along the boundary line between the housing recess portions and the seal surface or has a fore end projecting in a chevron shape. The cutter may be in any shape or material or the like without problem only if it is enabled to make a cut slit in the sheet at a boundary portion between the housing recess portions and the seal surface.

In this case, with a press by the press section, a cut slit can be made by the cutter before the sheet is broken. Therefore, the sheet can be broken promptly and smoothly. Also, a cut slit can be made in the sheet before the medicine is damaged due to the pressing force applied by the press section. Therefore, with the pressing force applied by the press section, the sheet can securely be broken before the medicine is damaged or deformed, making it possible to feed out medicines regardless of the type (hardness differences or the like) of the medicines.

Preferably, the cut slit made in the sheet is at a boundary portion between the housing recess portions and the seal surface.

It is noted here that the boundary portion between the housing recess portions and the seal surface refers to a portion including not only the boundary line but also its vicinal portions. For example, each side face of the housing recess portions is so tapered as to be gradually inwardly inclined with increasing nearness to the bottom face, with the housed medicine positioned inside the side face. Therefore, even though a cut slit is made in the side faces of the housing recess portions, the medicine is never damaged.

Since the cut slit is made at the boundary portion between the housing recess portions and the seal surface, the sheet necessarily begins to break at an end of the region where the sheet covers the housing recess portions, and then increases in breaking range. Therefore, it never occurs that part of the broken sheet falls off and mixes with the extracted medicine.

Preferably, the press section and the cutter are provided in juxtaposition so as to be integrally movable up and down, and the cutter gradually enlarges the cut slit as the pressing operation by the press section progresses. In this case, it becomes practicable to break the sheet smoothly by the pressing operation by the press section while the cut slit is being gradually enlarged.

Preferably, the press section has a pressing surface which gradually projects with increasing nearness to the cutter. In this case, the pressing force can be made to act on the sheet from a place near the formation of the cut slit, so that the sheet can be broken even more smoothly.

Preferably, in a case where the housing recess portions of the press through pack are formed in two lines, the press section and the cutter are provided for each of the two lines. The cutters are placed in juxtaposition inside the two press sections.

Generally, a press through pack in which the housing recess portions are formed in two lines has a tendency that the sheet side is deformed so as to project at the center line. Therefore, making cut slits in the sheet on the central portion side by the cutters makes it achievable to smoothly break the sheet.

The cutter may also be placed at a position where the cutter is enabled to make a cut slit in the sheet surface as the press through pack moves along its conveyance path.

In this case, preferably, the cutter is provided at two places along the conveyance path of the press through pack, and the device further comprises a distance adjustment section that is capable of adjusting a distance between the cutters. This is because it becomes practicable to make cut slits at proper places in various forms of the press through packs.

DETAILED DESCRIPTION OF THE PREFERRED EMBODIMENTS

Hereinbelow, embodiments according to the present invention are described based on the accompanying drawings.

Figure 1:
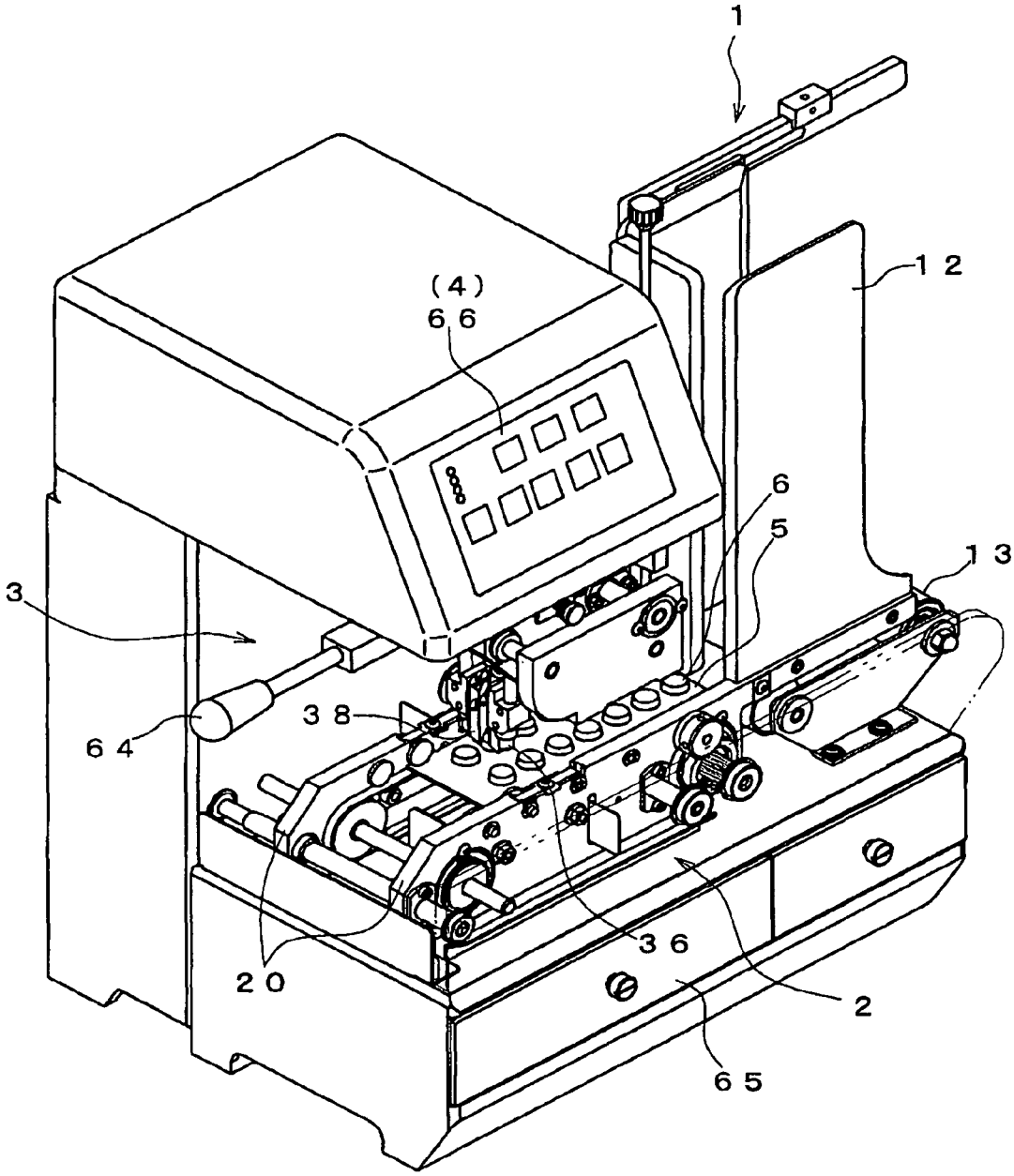
FIG. 1 is a perspective view showing a medicine feeding device according to a first embodiment of the invention.

FIG. 1 shows a medicine feeding device according to a first embodiment of the invention. This medicine feeding device, which includes a medicine feeding section 1, a medicine conveyance section 2, a medicine extracting section 3 and a control section 4, is used to feed out a medicine 6 from a press through pack 5 (hereinafter, abbreviated as PTP).

Figure 12:
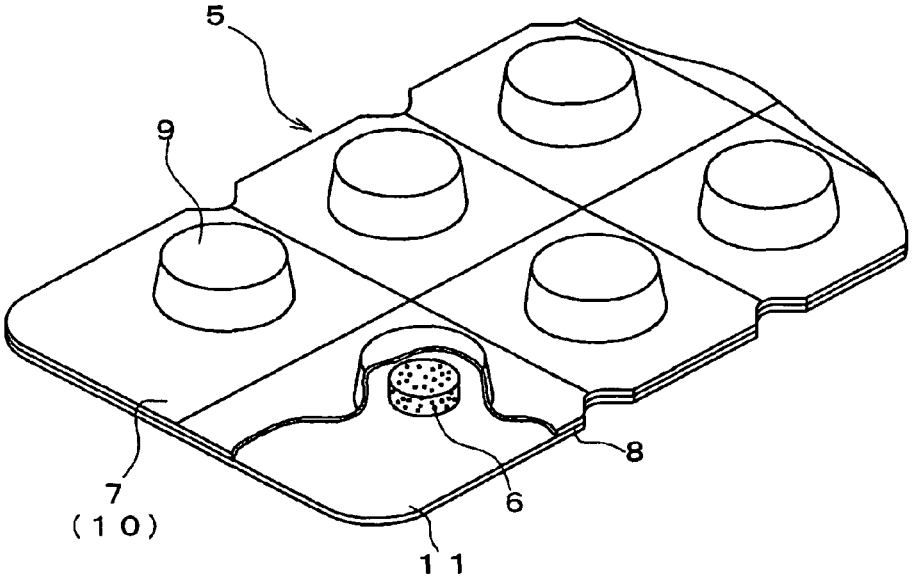
FIG. 12 is a partly broken perspective view showing the PTP.

The press through pack 5 used in this case, as shown in FIG. 12, is so formed that a plurality of housing recess portions 9 are provided in two lines on a seal surface 8 side of a plate-like member 7 to form a housing member 10, and with medicines 6 housed in the housing recess portions 9, a sheet 11 is stuck to the seal surface 8 of the housing member 10.

Figure 2:
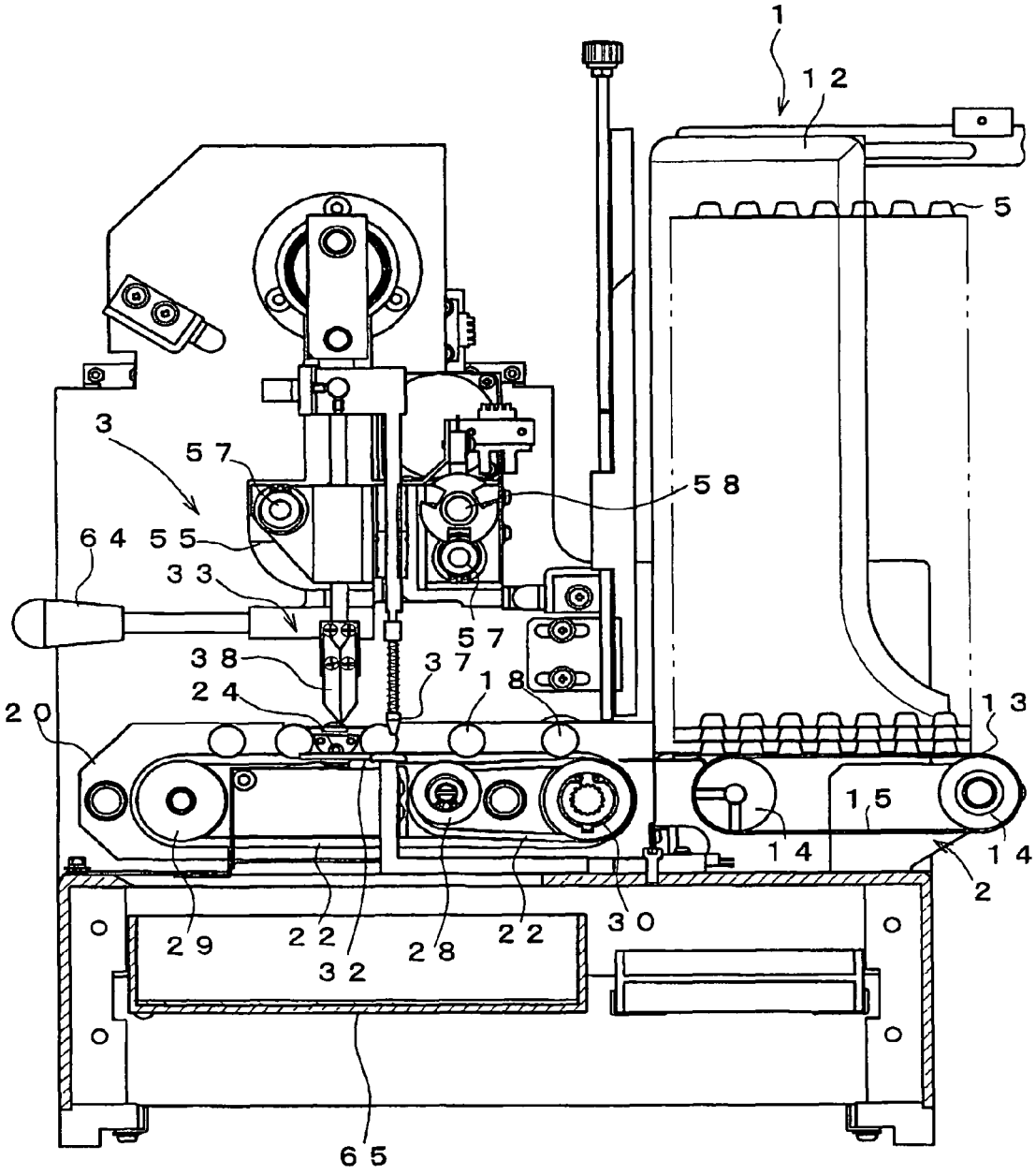
FIG. 2 is a partial sectional front view of the medicine feeding device according to the first embodiment.

The medicine feeding section 1, as shown in FIG. 2, includes a stocker 12 and a belt conveyor 13. In the stocker 12, PTPs 5 are stacked with their seal surfaces 8 positioned downward and fed to the belt conveyor 13 one by one successively. The belt conveyor 13 has a belt 15 (a wide belt is used here) stretched between a pair of pulleys 14. The driving force of a motor 16 is transferred to one pulley 14 via a drive shaft 16*a* as shown in FIG. 6.

Figure 6:
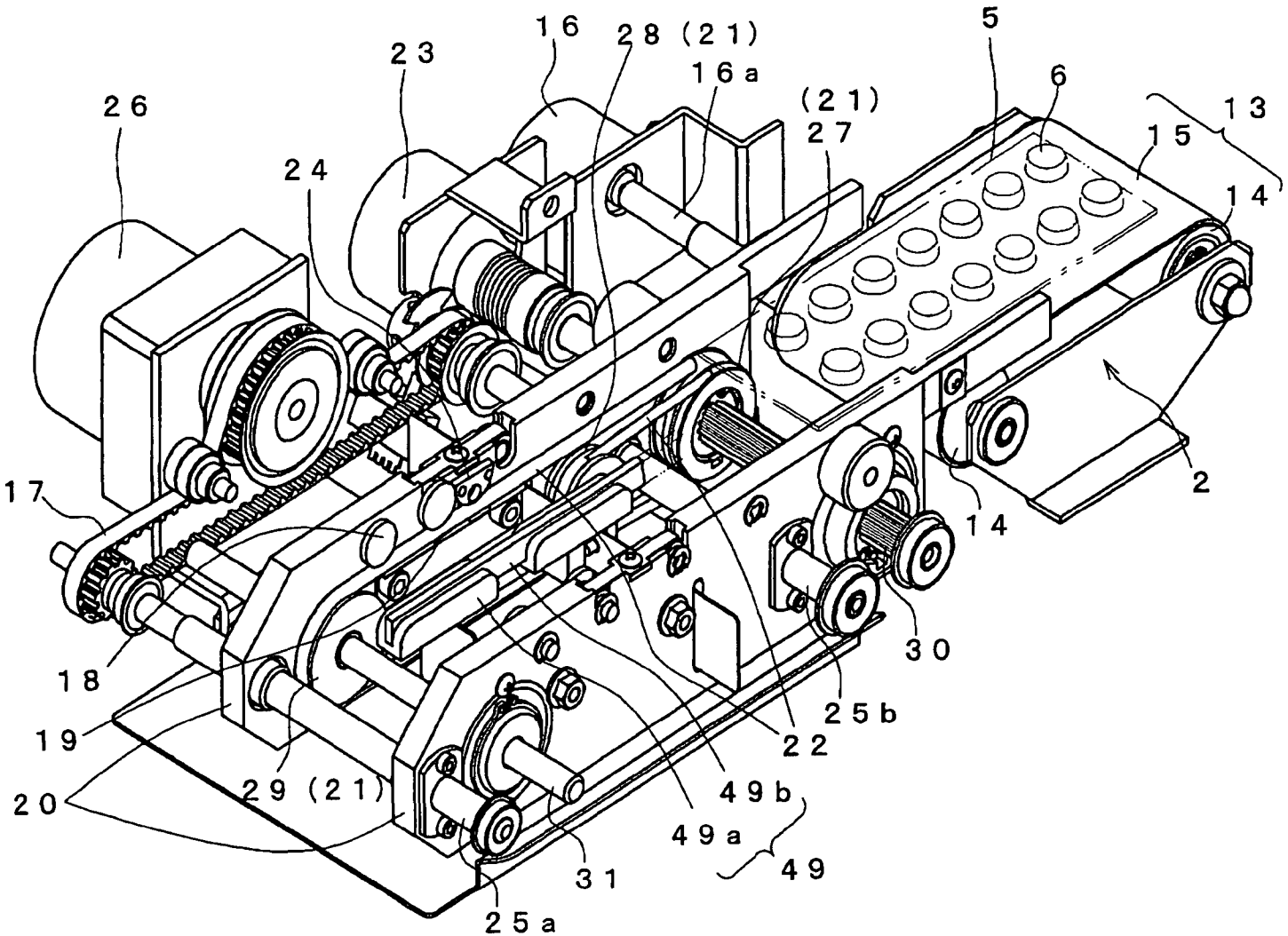
FIG. 6 is a perspective view showing a lower half portion of the medicine feeding device according to the first embodiment.

The medicine conveyance section 2, as shown in FIG. 6, is formed so that a plurality of pulleys 21 are provided on a pair of guide plates 20, respectively, which are provided so as to be adjustable in their distance, with belts 22 (round belts are used here) stretched between the pulleys 21. A medicine detection sensor 24 for detecting the housing recess portions 9 of a passing PTP 5 is provided in the medicine conveyance section 2. This medicine detection sensor 24, which is composed of a light-emitting element and a light-receiving element placed on both sides of the conveyance path for the PTPs 5, respectively, detects the presence or absence of the PTP 5 depending on light shielded by the housing recess portions 9.

Screw shafts 25 are provided so as to extend through the guide plates 20 in a screwed state. The screw shafts 25 are screwed with the individual guide plates 20 in opposite directions, so that rotating screw shafts 25*a*, 25*b* via a timing belt 17 by a motor 26 causes the guide plates 20 to approach or separate from each other. The pulleys 21 include driving pulleys 27, a first driven pulley 28 and a second driven pulley 29. The driving pulleys 27 include one set of inner and outer driving pulleys, on which the belts 22 are stretched against the first driven pulley 28 and the second driven pulley 29, respectively. A spline shaft 30 extends through the driving pulleys 27, and a slide shaft 31 rotatably extends through the first driven pulley 28 and the second driven pulley 29. As a result of this, the pulleys 21 (27, 28, 29) are able to approach or separate from each other together with the guide plates 20. Then, as the spline shaft 30 is rotated by a pulse motor 23, the first driven pulley 28 and the second driven pulley 29 are rotationally driven from the driving pulleys 27 via the belts 22. Also, a plurality of guide rollers 18 are rotatably provided on the guide plates 20. Below the belt 22 is placed a guide plate 19. Then, a side edge portion of the press through pack 5 is pinched between the guide rollers 18, the belt 22 and the guide plate 19. Further, between the two guide plates 20 is placed a guide block 49. The guide block 49 is formed by coupling together a plurality of pressure-contact blocks 49*a* by a block piece 49*b*, where the pressure-contact blocks 49*a* are brought into pressure contact with the PTP 5 by making the block piece 49*b* pressed against a later-described pressure-contact rod 37. The guide block 49, which is fitted at a fore end of an arm (not shown) rotatably provided on a support frame 52, can be withdrawn to another position when unnecessary.

Figure 3:
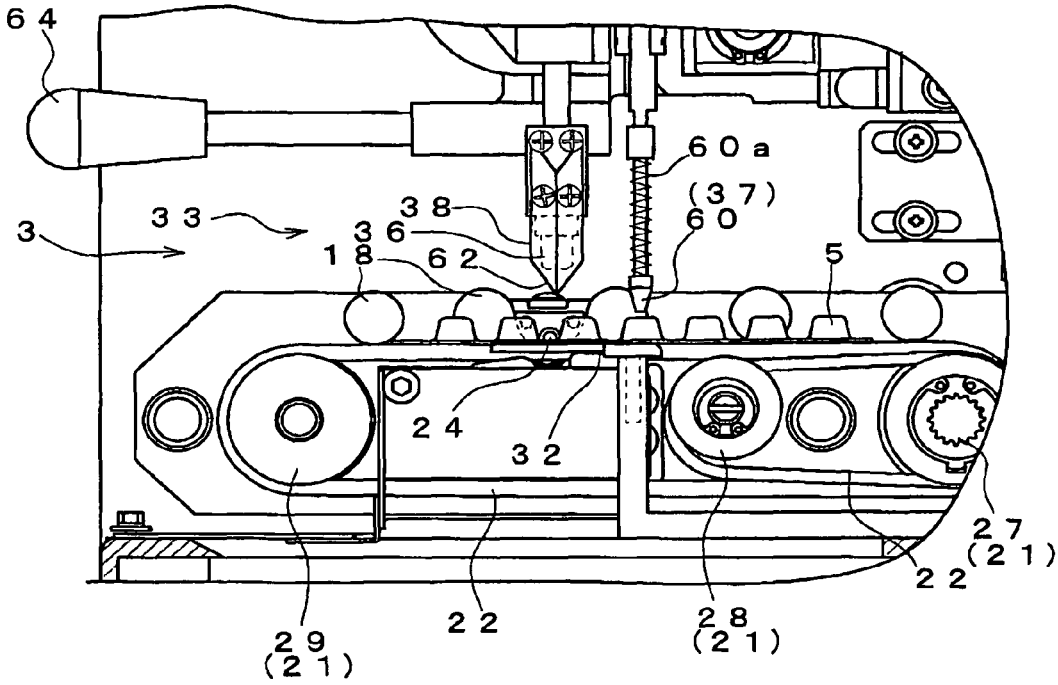
FIG. 3 is a partial enlarged view showing a medicine extracting section of FIG. 2.

The medicine extracting section 3, as shown in FIGS. 2 and 3, includes a support portion 32 and a press section 33 and is placed at a midway point on the medicine conveyance section 2.

Figure 4:
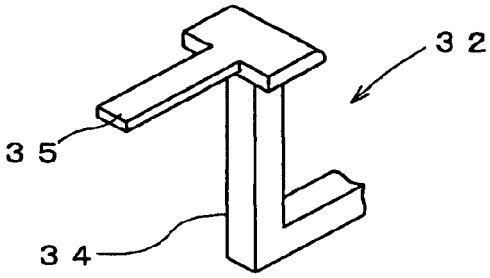
FIG. 4 is an enlarged perspective view showing a support portion of FIG. 3.

The support portion 32, as shown in FIG. 4, is composed of a support base 34 and an auxiliary base 35 which is removably fittable to the support base 34. The auxiliary base 35 is prepared in various types corresponding to types of the PTP 5, and used in replacement as required.

The press section 33, as shown in FIG. 3, includes a push-out rod 36, a pressure-contact rod 37 and a cutter 38.

Figure 5:
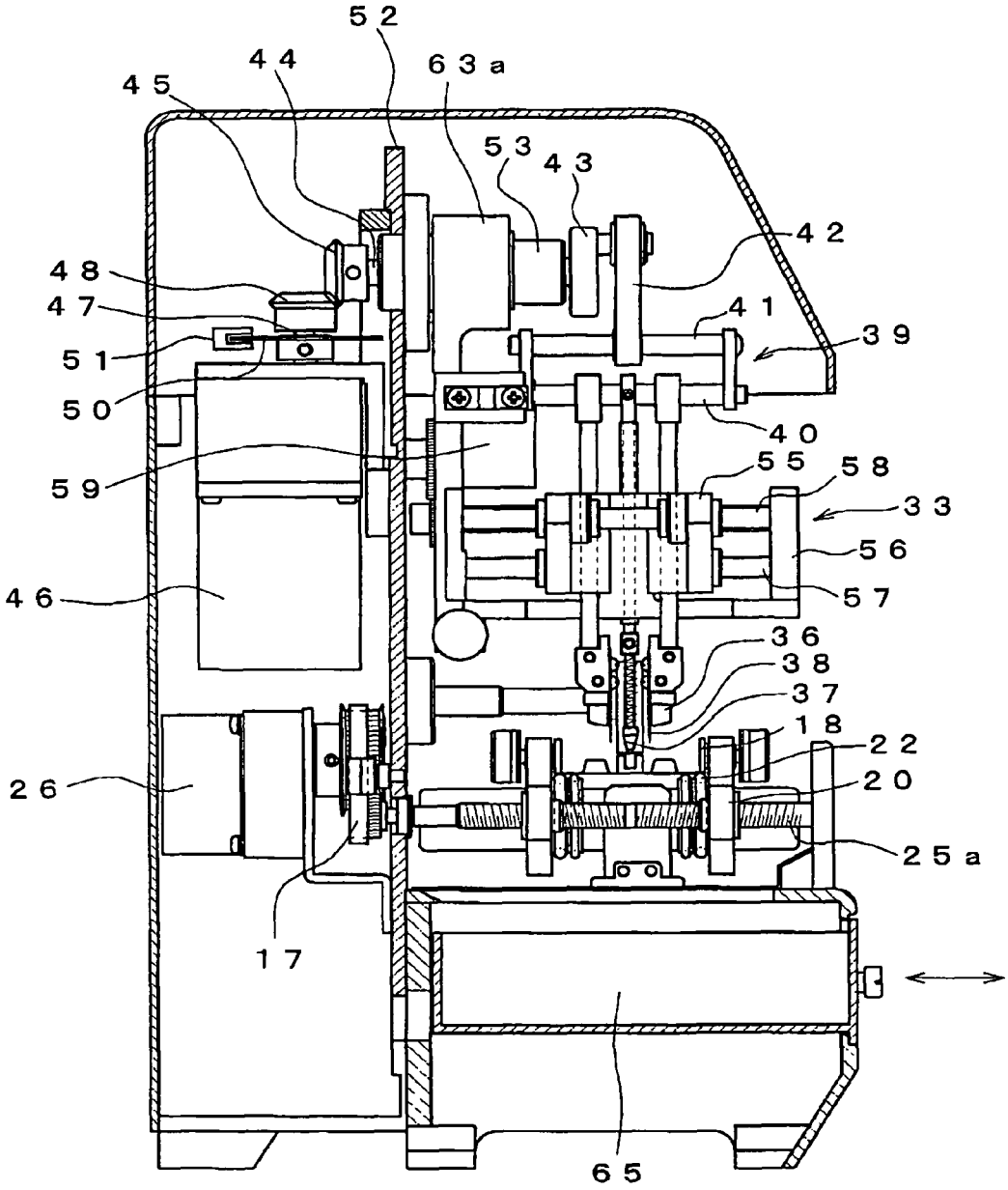
FIG. 5 is a side-face sectional view of the medicine feeding device according to the first embodiment.
Figure 7:
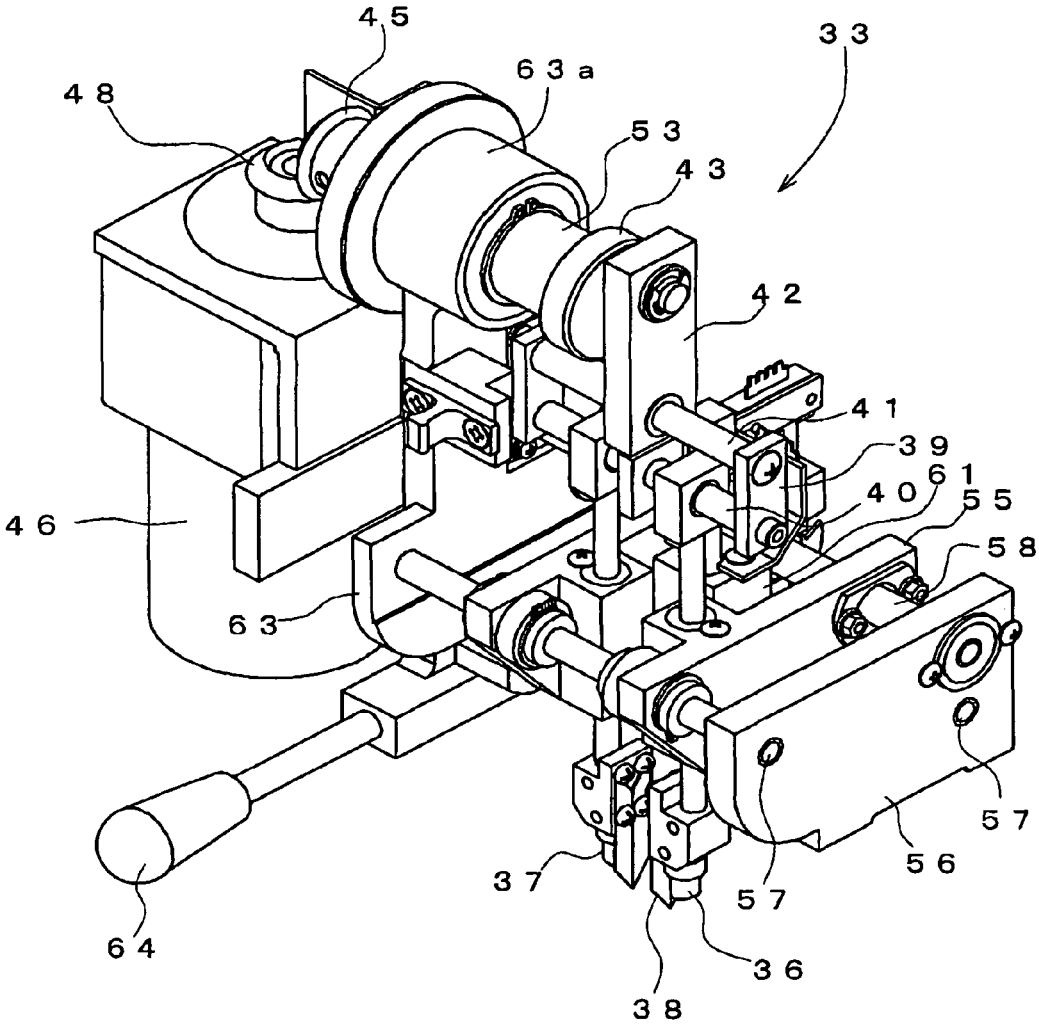
FIG. 7 is a perspective view showing a press position of FIG. 2.

The two rods 36, 37, as shown in FIGS. 5 and 7, have their upper end portions rotatably coupled to a first coupling rod 40 of a coupling member 39. A second coupling rod 41 of the coupling member 39 is coupled to a driving wheel 43 via an arm 42 at a position decentered from the rotational center. The driving wheel 43 is provided at one end portion of a driven shaft 44, while a first bevel gear 45 is provided at the other end portion of the driven shaft 44. The bevel gear 45 is meshed with a second bevel gear 48 provided on a driving shaft 47 of a motor 46 so that driving force of the motor 46 is transferred to the bevel gear 45. Thus, driving the motor 46 causes the two rods 36, 37 to ascend and descend, via the bevel gears 45, 48, the driving wheel 43 and the coupling member 39. Also, the second bevel gear 48 has a disc 50 in which a plurality of slits (not shown) are formed circumferentially at a specified pitch. The slits are detected by a photo-interrupter 51 and counted by a later-described control section 4. The control section 4 computes up-down positions of the two rods 36, 37 based on a counted number of detected slits. In addition, the driven shaft 44 is supported by a bearing portion 53 provided on the support frame 52.

Figure 8:
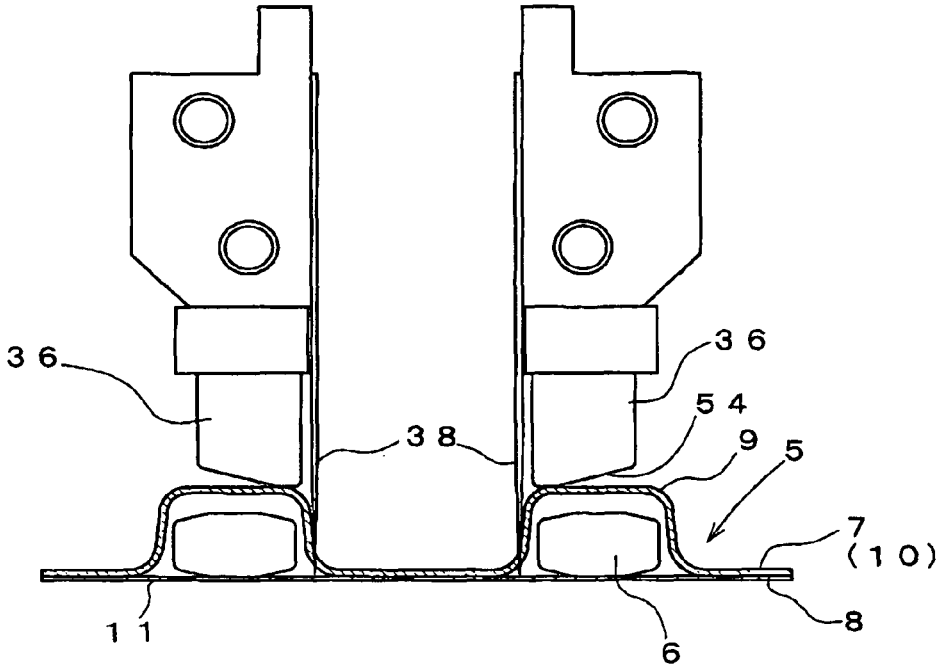
FIG. 8 is a sectional front view showing a state immediately before the medicine feed by the press position of FIG. 2.
Figure 9:
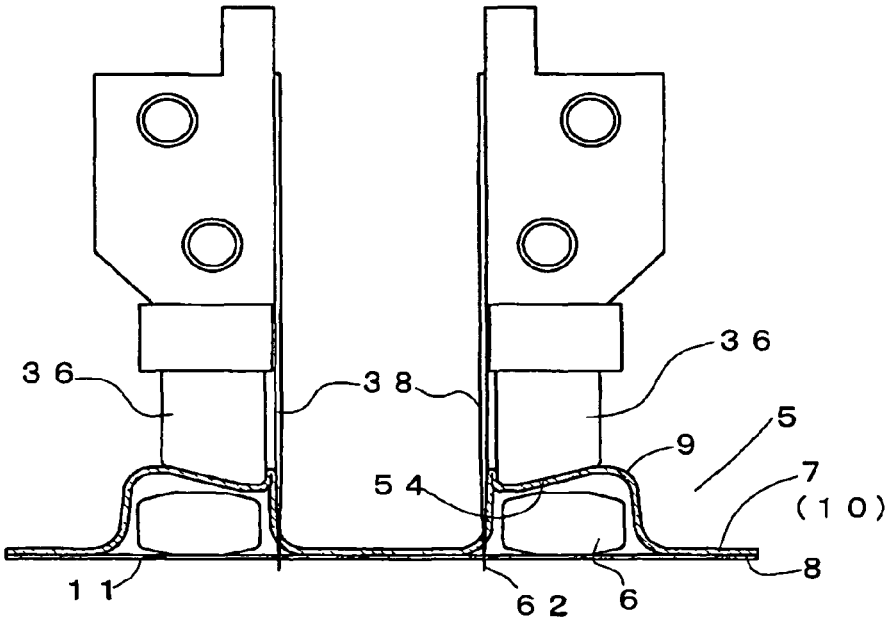
FIG. 9 is a sectional front view showing a state that the PTP is beginning to be cut by a cutter from FIG. 8.
Figure 10:
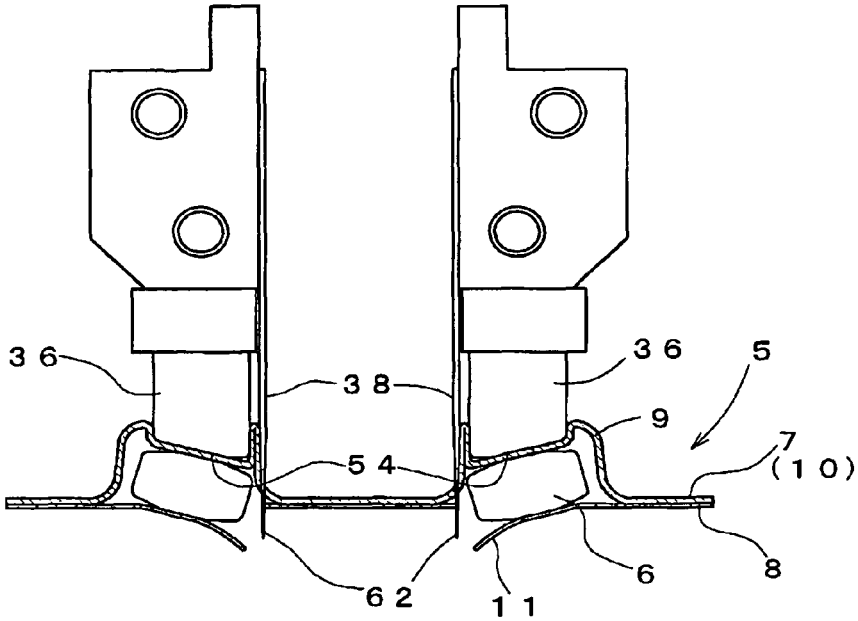
FIG. 10 is a sectional front view showing a state that medicines are pressed by the press rod to break the sheets from FIG. 9.
Figure 11:
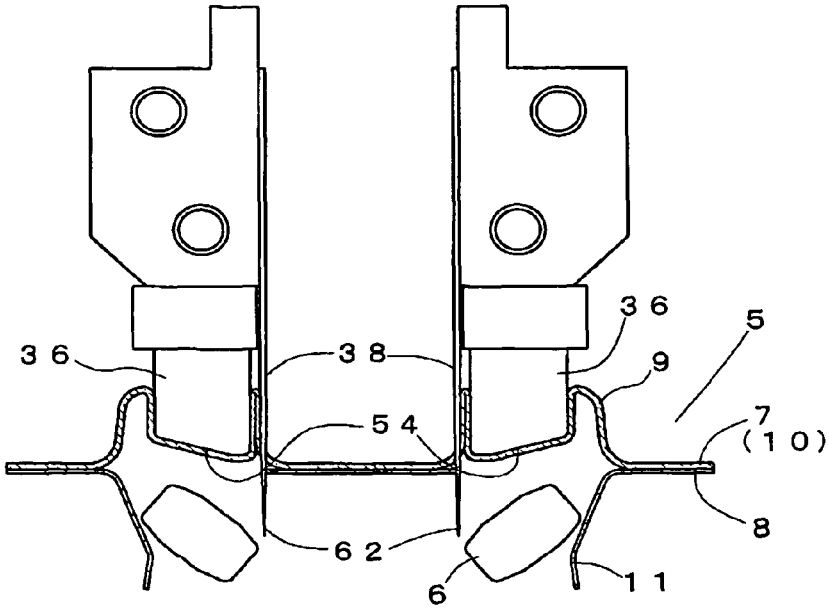
FIG. 11 is a sectional front view showing a state in which the medicines are further pressed by the press rod from FIG. 10, causing the medicines to drop.

The push-out rods 36, as shown in FIGS. 7 and 8, are juxtaposed at two sites in correspondence to the individual lines of the housing recess portions 9 formed in the PTP 5. An inclined surface (pressing surface) 54 is formed at a fore end portion of each push-out rod 36. The inclined surfaces 54 are formed so as to be projective on the sides on which the juxtaposed push-out rods 36 approach each other. That is, each inclined surface 54 is formed so that when the housing recess portion 9 of the PTP 5 is pressed by the push-out rod 36, the pressing force begins to act first on the inner side, i.e., a side on which a cut slit is formed by the later-described cutter 38. Then, as the sheet 11 is pressed by the medicine 6 so as to be broken, the pressing force acts so that the medicine 6 housed in the housing recess portion 9 is forcedly inclined along the inclined surface 54. The push-out rods 36, whose intermediate portions extend through juxtaposed guide members 55, are guided up-and-down movably by the guide members 55. A guide frame 56 is provided on the outer periphery of the guide members 55. The guide frame 56 is equipped with a slide shaft 57 and a screw shaft 58, where the slide shaft 57 extends through both end portions of the guide members 55 and the screw shaft 58 is screwed with the guide members 55 in a neighborhood of one slide shaft 57. The screw shaft 58 is screwed in opposite screwing directions between the individual guide members 55. Accordingly, a motor 59 is driven to rotate the screw shaft 58 (see FIG. 5) which causes the screwing position to be changed, by which the guide members 55 go nearer and farther along the slide shaft 57.

Figure 13:
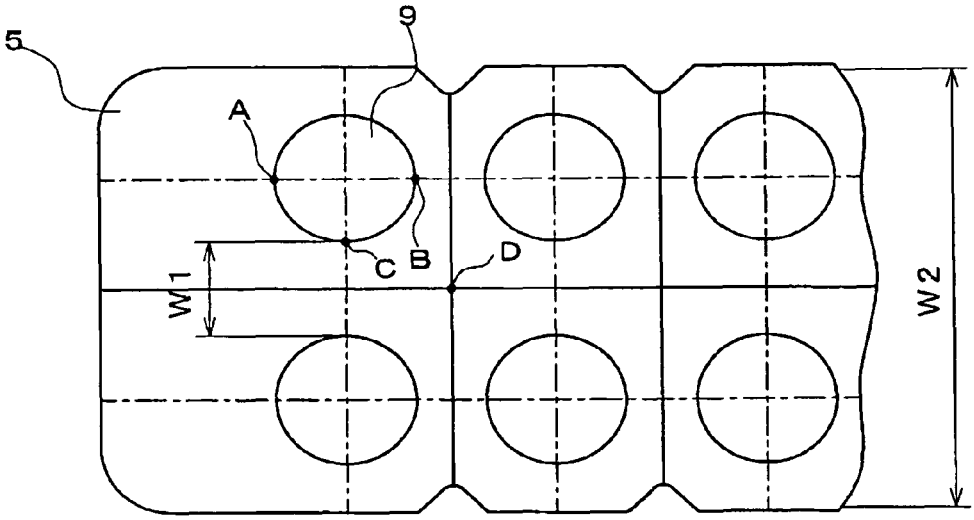
FIG. 13 is a plan view of the PTP shown in FIG. 12.

The pressure-contact rod 37 is so positioned as to be able to apply pressure-contact to a site between the housing recess portions 9 of the PTP 5 (i.e., a center position of four adjacent housing recess portions 9; indicated by D in FIG. 13). As shown in FIG. 3, a changeable chip 60 is provided at a fore end portion of the pressure-contact rod 37. The chip 60 is provided together with a spring 60*a*, and urged downward by the spring 60*a*. Thus, as the pressure-contact rod 37 is lowered, the chip 60 goes elastically into pressure contact with the guide block 49, so that the guide block 49 comes into pressure contact with the PTP 5, thereby preventing its displacement. Also, the pressure-contact rod 37, which extends through a holder 61 (see FIG. 7) whose intermediate portion is fixed to the guide frame 56, is guided up-and-down movably by the holder 61.

The cutters 38, as shown in FIGS. 3, 7 and 8 through 11, are provided in juxtaposition with the push-out rods 36 and are removably attached. The or each cutter 38 has a cutting edge 62 with a chevron-shaped fore end so as to be able to make a cut slit at a boundary portion between the housing recess portions 9 and the seal surface 8 of the PTP 5. Preferably, the cutter 38 is so positioned as to be able to make a cut slit at a position which is on the boundary line between the housing recess portions 9 and the seal surface 8 and at which neighboring housing recess portions 9 in each line thereof are in the closest proximity to each other (indicated by C in FIG. 13). However, the cut slit, if it does not interfere with the medicine 6, may be formed at a recess portion (side face portion). This is because the side face portion of the housing recess portion 9 is formed with such an inclination as to gradually enlarge with increasing nearness to the opening end face, and therefore forming the cut slit at this inclination portion never causes damage to the housed medicine 6. In particular, a place near the opening edge portion of the housing recess portion 9 immediately before the seal surface 8 is preferable since this location includes formation of a generally flat portion which allows the cutter 38 to make a cut slit thereinto and at which the medicine 6 cannot be positioned. It is set that making a cut slit in the PTP 5 by the cutter 38 is to be done after the PTP 5 has been positioned by the pressure-contact rod 37. Further, the cutter 38 is not limited to one which makes a linear cut slit but the cutter 38 may make a curved cut slit along the opening edge portion of the housing recess portions 9.

The guide frame 56, as shown in FIGS. 5 and 7, is fixed to a support plate 63, and the bearing portion 53 provided on the support frame 52 extends through an upper cylindrical portion 63*a* of the support plate 63, is rotatably supported. A lever 64 is fixed to the guide frame 56, and the whole guide frame 56, on which the press section 33 is provided, can be rotated about the bearing portion 53 by grasping and operating the lever 64. As a result of this, it is possible to move the push-out rods 36, the pressure-contact rod 37 and the cutter 38 of the press section 33 to positions where their replacement is enabled.

Figure 14:
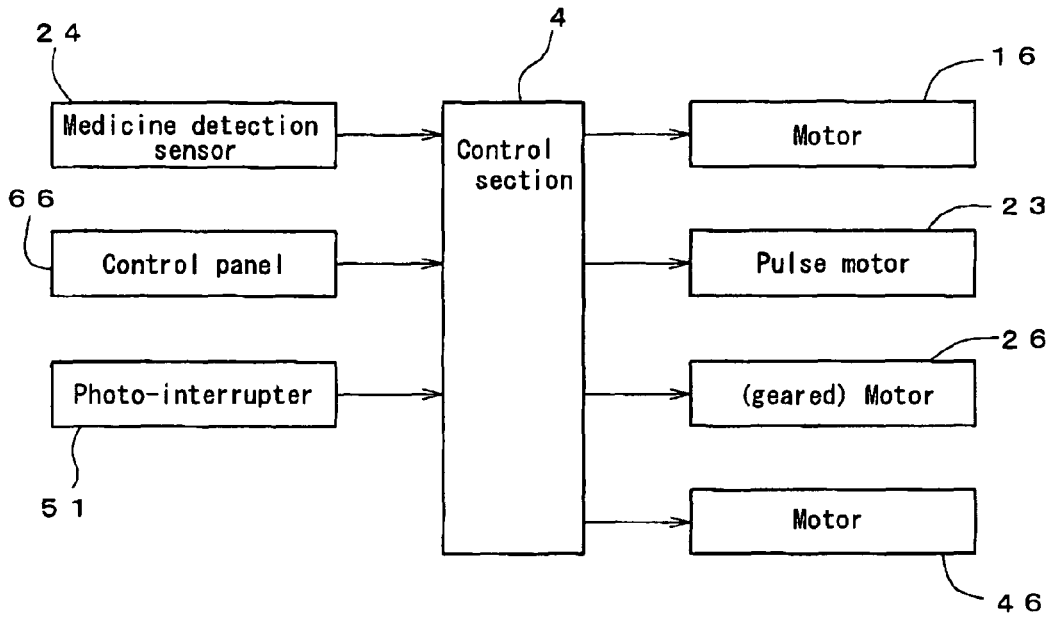
FIG. 14 is a block diagram of the medicine feeding device according to this embodiment.

The control section 4, as shown in FIG. 14, performs drive control over the motors 16, 26, 46 based on an input signal derived from each photo-interrupter 51, the medicine detection sensor 24 or a later-described control panel 66 to extract the medicine 6 from the PTP 5.

It is noted that reference numeral 65 denotes a medicine recovery box for recovering the medicine 6 extracted from the PTP 5 by the push-out rods 36.

Also, reference numeral 66 denotes a control panel which has switches including a start switch, a stop switch, a data setting switch and a mode setting switch, as well as an LED display section for displaying set data.

Next, operation (center distance determining process and medicine feeding process) of the medicine feeding device having the above-described construction is explained.

(Center Distance Determining Process)

Figure 15:
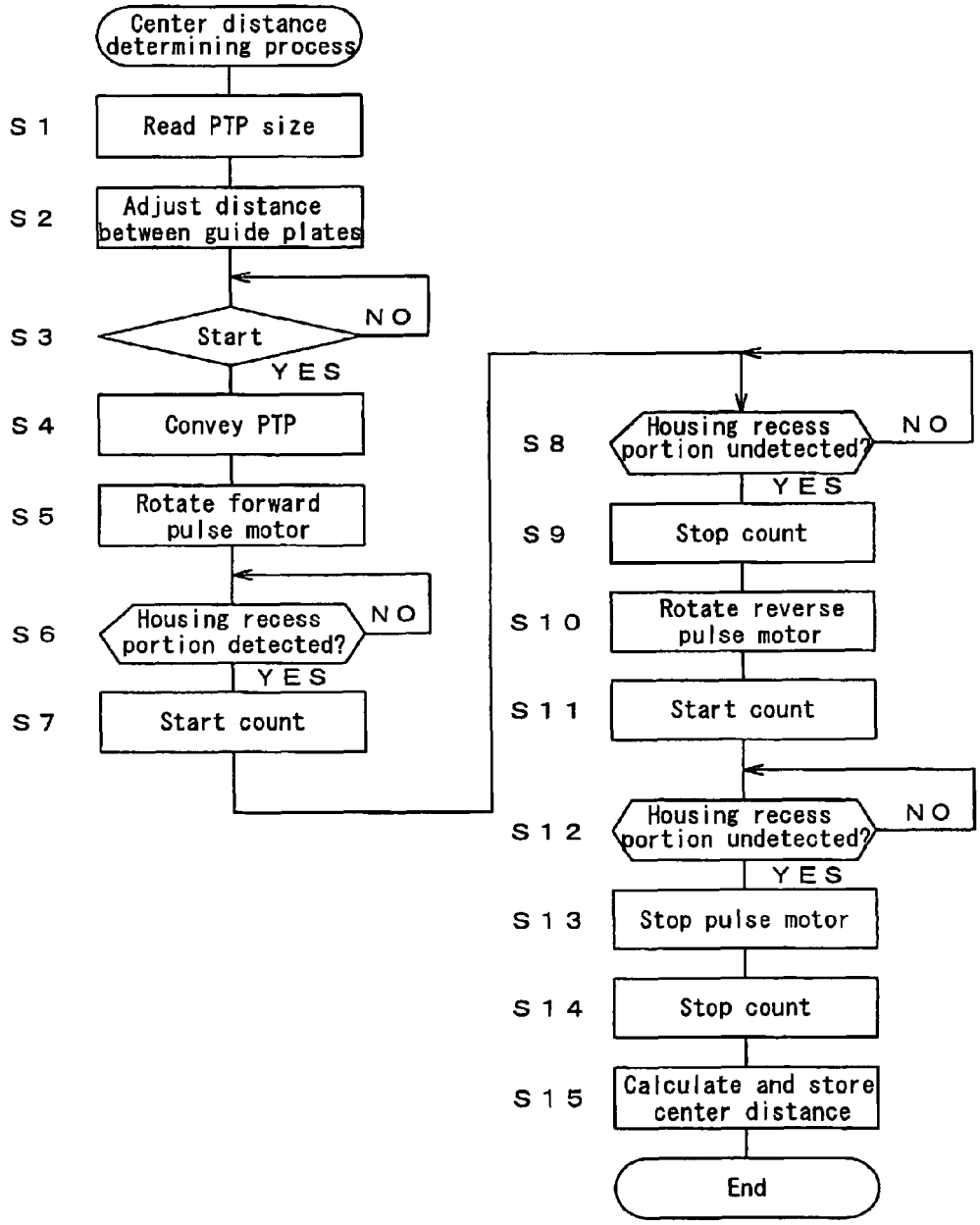
FIG. 15 is a flowchart showing a center distance determining process.

As shown in the flowchart of FIG. 15, the size of the PTPs 5 housed in the stocker 12 is preparatorily read (draw width W1, sheet width W2; see FIG. 13) (step S). Then, based on this size data, drive of the motor 26 is controlled and the distance between the guide plates 20 is adjusted, so that the distance between the press section 33 and the cutter 38 is set for a proper position (step S2). More specifically, the position is one that allows the cutter 38 to make a cut slit at the boundary portion between the housing recess portions 9 and the seal surface 8 of the PTPs 5. Since the housing recess portions 9 are formed in two lines in the PTPs 5, the cutter 38 is positioned upward of a line that interconnects points which are in the inner side portion of the respective lines, (i.e., in the boundary portion between the housing recess portions 9 and the seal surface 8) and which are the positions of the closest proximity between the housing recess portions 9 of the respective lines (indicated by C in FIG. 13). Also, the PTPs 5 are housed in the stocker 12 in a stacked state with their sheet side down.

Then, the start switch on the control panel 66 is operated (step S3), by which the belt conveyor 13 is driven in the medicine feeding section 1 so that the PTPs 5 within the stocker 12 are conveyed in order, starting with the PTP located at the lowermost place (step S4). The PTP 5 is conveyed to the medicine extracting section 3 by the medicine conveyance section 2. The medicine extracting section 3 drives the pulse motor 23 into forward rotation (step S5), continuing the conveyance of the PTP 5.

Then, when a forward end (indicated by A in FIG. 13) of the housing recess portions 9 is detected by the medicine detection sensor 24 (step S6), the number of drive pulses of the pulse motor 23 is counted based on the detection signal (ON signal) (step S7). Then, when the housing recess portions 9 are no longer detected by the medicine detection sensor 24 (i.e., if a rear end of the housing recess portions (indicated by B in FIG. 13); step S8), the counting of the number of drive pulses is stopped based on the detection signal (OFF signal) (step S9), while the drive of the pulse motor 23 is stopped. Then, the pulse motor 23 is driven in reverse rotation (step S10, by which the counting of the number of drive pulses is restarted (step S12). Thereafter, when the housing recess portions 9 are no longer detected by the medicine detection sensor 24 so that the detection signal has changed from ON to OFF signal (step S12), the pulse motor 23 is stopped (step S13) and moreover the counting of the number of drive pulses is stopped (step S14). Then, the resulting count is cumulated on the already counted number of drive pulses (see step S9), and the resulting value is multiplied by a factor of ¼, by which a distance from the forward end of the housing recess portions 9 to the center position (hereinafter, referred to as center distance) is calculated and stored (step S15). This process is performed only for the first-place housing recess portion 9 with respect to the first PTP 5 for the calculation of the center distance.

(Medicine Feeding Process)

Figure 16:
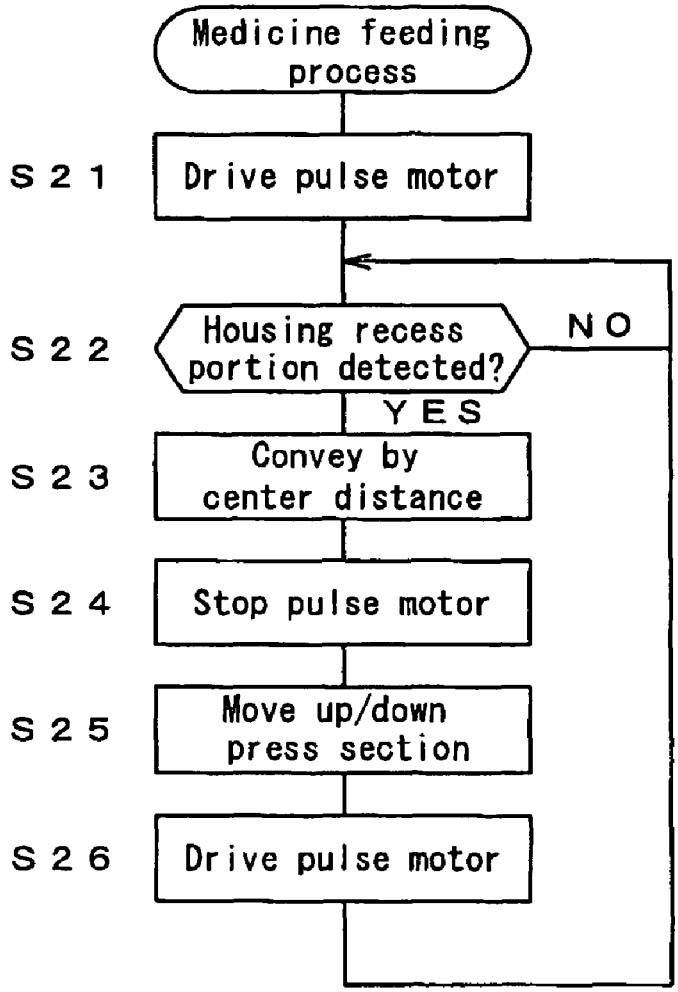
FIG. 16 is a flowchart showing a medicine feeding process.

With the center distance calculated in this way, as shown in the flowchart of FIG. 16, the pulse motor 23 is driven into forward rotation (step S21). With respect to the PTPs 5 conveyed up one after another, after the forward end of the housing recess portions 9 is detected by the medicine detection sensor 24 (step S22), the PTP 5 is conveyed further by the center distance (step S23), being once stopped (step S24). As a result of this, the centers of the push-out rod 36 and the housing recess portion 9 become coincident with each other, and the cutting edge of the cutter 38 is positioned upward at position C.

Now, the motor 46 is driven to make the press section 33 move up or down (step S25). That is, when the press section 33 is moved down, the fore end of the pressure-contact rod 37 elastically comes into pressure contact with the guide block 49, so that the guide block 49 makes pressure contact with the PTP 5, thereby preventing its displacement. Subsequently, the cutting edges 62 of the cutters 38 make cut slits in the PTP 5, gradually enlarging the cut slits. When this occurs, the push-out rods 36 press the medicines 6 of the housing recess portions 9, so that the medicines 6 press on the sheet 11. Since the fore end faces of the push-out rods 36 are the inclined surfaces 54 with their cutter 38 side projecting, the force acting on the sheet 11 applies to vicinities of the cut slits formed by the cutters 38. Accordingly, the sheet 11 begins break at the formed cut slits. Then, as the push-out rods 36 move further downward, the medicines 6 within the housing recess portions 9 are gradually inclined along the inclined surfaces 54 of the push-out rods 36. Also, the cutters 38 make the cut slits enlarged in range. As a result of this, the sheet 11 is broken smoothly from the cut slit side, eliminating the possibility that the sheet 11 may fall off. Still, since the sheet 11 has become liable to break because of the formed cut slits, it never occurs that any improper load may act on the medicines 6 within the housing recess portions 9, thus eliminating the possibility of faults such as deformation or chipping of the medicines 6.

The PTP 5 is usually so deformed that its center line side is protruding slightly on its sheet 11 side (in spite of being guided by the guide rollers 18, the guide plate 19, the guide block 49 and the support portion 32). Because of this, making a cut slit inside each line of the housing recess portions 9 with the cutter 38 as described above and starting and increasing the press at a vicinity of the cut slit cause the sheet 11 to be smoothly broken, allowing the medicine 6 to be easily extracted.

As the medicines 6 are extracted from the leading housing recess portions 9 of the individual lines in this way, the extracted medicines 6 drop and are recovered in the medicine recovery box 65. Then, the press section 33 is moved up, making the cutters 38, the push-out rods 36 and the pressure-contact rods 37 separate from the PTP 5 in this order. After that, the pulse motor 23 of the medicine conveyance section 2 is driven to convey the PTP 5 (step S26).

Similarly after this, with the program returning to step S22, if a forward end of a housing recess portion 9 is detected by the medicine detection sensor 24 so that an ON signal is outputted, the operation is stopped at a time point when the PTP 5 has been conveyed to the center distance, and the above-described operation is iterated.

As shown above, according to this medicine feeding device, cut slits are formed preparatorily by the cutters 38 before the pressing of the housing recess portions 9 by the push-out rods 36, and thus the sheet 11 can be smoothly broken without involving any improper load on the medicines 6 that press the sheet 11. Still, since the sheet 11 starts to be broken from ends of the housing recess portions 9, there never occurs faults such as the dropping of part of the sheet 11 and its mixing into the medicines 6.

The above embodiment has been described in conjunction with a case where the PTPs 5 are of the type in which the housing recess portions 9 are formed in two lines for feeding of the medicines 6. However, the invention allows the housing recess portions 9 to be formed in one line or three or more lines without any problem. For example, in the case of three lines, it is appropriate that with the guide block 49 withdrawn to some other position, a push-out rod 46 instead of the pressure-contact rod 37 as well as the cutters 38 are mounted.

Further, the foregoing embodiment is so structured that cut slits are formed by making the cutters 38 approach and separate from the PTPs 5. However, the structure may also be as shown in FIGS. 17 and 18.

Figure 17:
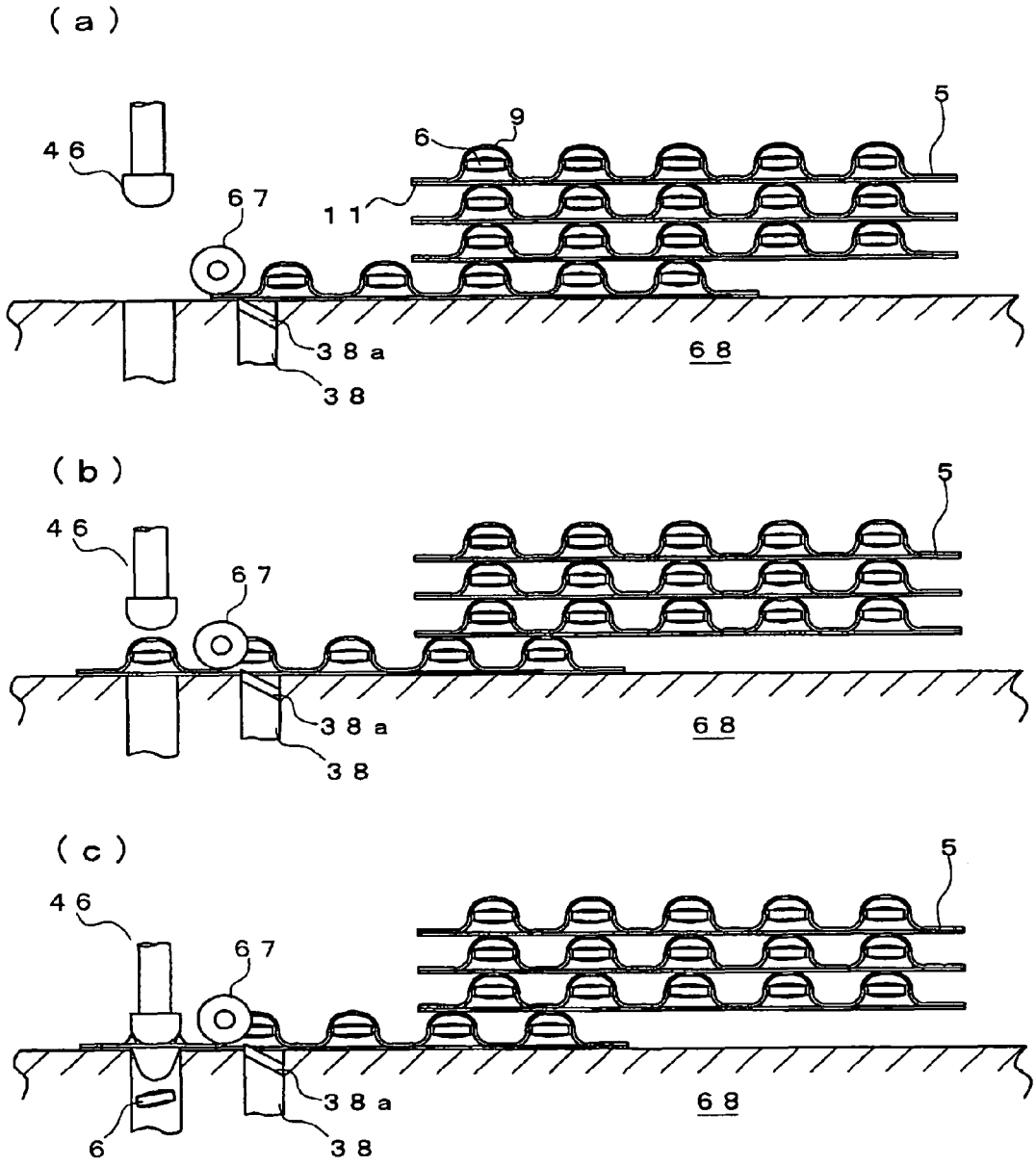
FIG. 17 is an outlined explanatory view of a medicine feeding device equipped with a cutter according to a second embodiment.

In FIG. 17, the PTPs 5 are conveyed in the longitudinal direction, where the cutter 38 is placed on the way of the conveyance path. The conveyance of the PTPs 5 is fulfilled by pinching both-side edge portions of the PTP 5 with an upper-side guide roller 67 and a lower-side support base 68 and then rotatably driving the guide roller 67. Although only one guide roller 67 is shown in FIG. 17, the guide roller 67 may be provided at sites necessary for the conveyance of the PTPs 5 as appropriate, those being omitted. Further, the illustrated guide roller 67 fulfills the role as a guide that prevents upward displacement of the PTPs 5 during the cutting of the sheet 11 by the cutter 38. The cutter 38, which has a thin plate shape, moves gradually upwardly projecting as it advances in the conveyance direction of the PTPs 5, with the upper-end inclined surface serving as a cutting edge 38*a*. The cutting edge 38*a* is provided at such a position as to pass through the center of the housing recess portion 9 of the PTP 5 and be able to cut only the sheet 11 of the PTP 5 by its chip end.

According to the structure shown in FIG. 17, as the guide roller 67 is driven into rotation to make the PTP 5 moved leftward, the sheet 11 is cut by the cutter 38 (see FIG. 17A). It is on the center line of the housing recess portion 9 and therefore the sheet 11 alone is cut, as previously described. In this operation, at the point of time when the housing recess portion 9 has been moved to the push-out position with the push-out rod 46 lowered, a neighborhood of the housing recess portion 9 is set (see FIG. 17B). Now the PTP 5 is stopped, and the push-out rod 46 is further lowered. As a result of this, the sheet 11 is broken by the push-out rod 46, allowing the housed medicine 6 to be extracted (see FIG. 17C).

Figure 18:
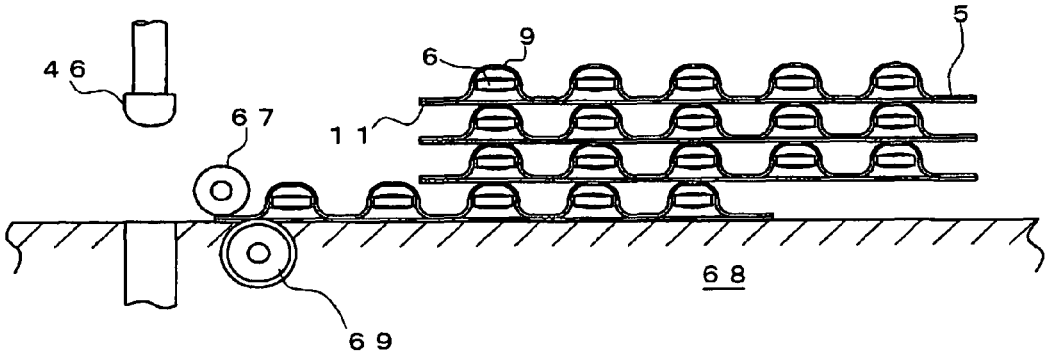
FIG. 18 is an outlined explanatory view of a medicine feeding device equipped with a cutter according to another embodiment.

In FIG. 18, a disc-shaped cutter (round type cutter) 69 is provided instead of the cutter 38 shown in FIG. 17. This cutter 69 is rotatable, and cuts the sheet 11 while rotating along with the conveyance of the PTP 5.

The cutter 38, 69 may appropriately be provided in correspondence to the particular array of the housing recess portions 9 of the PTPs 5, i.e., one for each one line of the housing recess portions 9. Besides, the position of the cutter 38, 69 (position in a direction perpendicular to the conveyance direction of the PTPs 5) is preferably made freely adjustable according to the form of the PTPs 5. Also, two of the cutters 38, 69 may be provided for each line of the housing recess portions 9. In this case, preferably, the width of the cutter 38, 69 is made freely changeable according to the form of the housing recess portions 9. Furthermore, it is also possible that the position of the cutter 38, 69 is adjustable in the vertical direction. It is still also possible that the position of the cutter 38, 69 is one that allows the sheet 11 to be completely cut or another that causes the sheet 11 to be flawed and made easily breakable.

What is claimed is:

1. A medicine feeding device for feeding medicines from a press through pack in which a housing member is formed with a plurality of housing recess portions provided in at least one line on a seal surface side of a plate-shaped member and in which a sheet is stuck to the seal surface of the housing member with medicines housed in the housing recess portions, the medicine feeding device comprising:

a support portion for supporting the seal surface side of the press through pack;

a press section comprising a first pressing member for pressing the housing recess portions from one side other than the seal surface side of the press through pack; the press section further comprising a second pressing member for contacting the press through pack at locations that do not include the housing recess portions; and a cutter for making discrete cut slits less than a width of the press through pack at a part of a boundary portion between the housing recess portions and a seal surface of the sheet at least before the sheet is broken or the medicine is damaged by a pressing force exerted by the press section, the cutter and the pressing section being disposed on the same side of the support portion, wherein the first pressing member is provided at a position so as to be able to press one of the housing recess portions while the cutter is provided at a position to be able to make a cut slit at the part of the boundary portion between the housing recess portions and the seal surface of the sheet, wherein the first pressing member, the second pressing member and the cutter are movable upward and downward as an integrated structure, and the cutter is provided so as to make a cut slit after the press through pack is positioned by second pressing member, wherein the support portion does not support the seal surface side of the press through pack at a position directly under the housing recess portion being pressed by the first pressing member during a cutting operation.

2. The medicine feeding device as claimed in claim 1, wherein the cutter has an inclined cutting blade at a fore end thereof, the cutter being shaped so as to make a cut slit that gradually enlarges during the pressing operation of press section.

3. The medicine feeding device as claimed in claim 1, wherein a press surface of the press section includes an inclined surface that is inclined downwardly toward the cutter.

4. The medicine feeding device as claimed in claim 1, further comprising:

a medicine conveyance section for conveying the press through pack;

a medicine detection sensor for detecting the housing recesses in the press through pack conveyed by the medicine conveyance section; and a control section for running a center distance determining process to calculate a center position of a housing recess based on the travel distance from the beginning time to the finishing time when the housing recess is detected by the medicine detection sensor, and for making the press section position at the center of the hosing recess, and pressing the press section so as to remove the medicine from the press through pack.

5. The medicine feeding device as claimed in claim 1, wherein the press section includes a push-out rod and a pressure-contact rod for elastically applying pressure contact to the press through pack at a location between the recess portions.

6. The medicine feeding device as claimed in claim 5, wherein the push-out rod has an inclined surface at a lower end thereof.

7. The medicine feeding device as claimed in claim 6, wherein the cutter is removably attached at one side of the push-out rod.

8. The medicine feeding device as claimed in claim 7, wherein the cutter is adapted to cut a linear slit in the press through pack.

9. A medicine feeding device for feeding medicines from a press through pack in which a housing member is formed with a plurality of housing recess portions provided in at least first and second lines on a seal surface side of a plate-shaped member and in which a sheet is stuck to the seal surface of the housing member with medicines housed in the housing recess portions, the medicine feeding device comprising:

a support portion for supporting the seal surface side of the press through pack;

a first press section for pressing the housing recess portions arranged in the first line from one side other than the seal surface side of the press through pack;

a second press section for pressing the housing recess portions arranged in the second line from one side other than the seal surface side of the press through pack;

a first cutter for making a cut slit at a part of a boundary portion between the housing recess portions in the first line and a seal surface of the sheet at least before the sheet is broken or the medicine is damaged by a pressing force exerted by the press section; and a second cutter for making a cut slit at a part of a boundary portion between the housing recess portions in the second line and a seal surface of the sheet at least before the sheet is broken or the medicine is damaged by a pressing force exerted by the press section, wherein the cutters are positioned between the first and second press sections.

10. A medicine feeding device for feeding medicines from a press through pack in which a housing member is formed with a plurality of housing recess portions provided in at least one line on a seal surface side of a plate-shaped member and in which a sheet is stuck to the seal surface of the housing member with medicines housed in the housing recess portions, the medicine feeding device comprising:

a support portion for supporting the seal surface side of the press through pack so that the housing recess portions are directed upwardly;

a pressing member comprising a first pressing member, disposed above the support portion, for pressing the housing recess portions from an upper side of the support portion; the pressing member further comprising a second pressing member for contacting the press through pack at locations that do not include the housing recess portions; and at least one cutter removably attached to the pressing member, the cutter being adapted to pass through the housing member and sheet at a boundary portion between one of the housing recess portions and a seal surface of the sheet before the sheet is broken or the medicine is damaged by a pressing force exerted by the first pressing member, wherein the cutter and the pressing member are disposed on the same side of the support portion so that the cutter and the pressing member are disposed over the press through pack when the press through pack is supported on the support portion, and wherein the first pressing member, the second pressing member and the cutter are movable together in a vertical direction, and the cutter is positioned relative to the first and second pressing members so that the cutter is able to pass through the housing member and the sheet before the first pressing member engages a recess portion of the housing member when the press through pack is supported by the support portion.

11. The medicine feeding device as claimed in claim 10, wherein a press surface of the pressing member includes an inclined surface that is inclined downwardly toward the cutter.

12. The medicine feeding device as claimed in claim 10, further comprising a driving device for simultaneously driving the pressing member and the cutter in the vertical direction.

* * * * *